US005395223A

United States Patent [19]

Kuroki et al.

[11] Patent Number: 5,395,223

[45] Date of Patent: Mar. 7, 1995

[54] SCROLL TYPE COMPRESSOR HAVING COMMUNICATION PASSAGE MEANS WITH LUBRICATING ARRANGEMENT ASSOCIATED THEREWITH

[75] Inventors: Kazuhiro Kuroki; Tetsuhiko Fukanuma; Yuji Izumi; Tetsuo Yoshida, all of Kariya, Japan

[73] Assignee: Kabushiki Kaisha Toyoda Jidoshokki Seisakusho, Kariya, Japan

[21] Appl. No.: 19,043

[22] Filed: Feb. 18, 1993

[30] Foreign Application Priority Data

Feb. 21, 1992 [JP] Japan ..... 4-034894

[51] Int. Cl.[6] ..... F04C 18/04; F04C 29/02

[52] U.S. Cl. ..... 418/55.2; 418/55.6; 418/100

[58] Field of Search ..... 418/55.1, 55.2, 75, 418/78, 55.6, 100

[56] References Cited

U.S. PATENT DOCUMENTS

| | | | |
|---|---|---|---|
| 4,303,379 | 12/1981 | Hiraga et al. | 418/55.2 |
| 4,417,863 | 11/1983 | Ikegawa et al. | 418/55.2 |
| 5,120,205 | 6/1992 | Ban et al. | 418/100 |
| 5,145,344 | 9/1992 | Haga et al. | 418/55.2 |
| 5,221,198 | 6/1993 | Izumi et al. | 418/100 |

FOREIGN PATENT DOCUMENTS

| | | |
|---|---|---|
| 0012616 | 2/1984 | European Pat. Off. . |
| 57-137601 | 8/1982 | Japan . |
| 60-125382 | 8/1985 | Japan . |
| 61-197786 | 9/1986 | Japan . |
| 62-88893 | 6/1987 | Japan . |
| 62-108581 | 7/1987 | Japan . |

*Primary Examiner*—John J. Vrablik

*Attorney, Agent, or Firm*—Brooks Haidt Haffner & Delahunty

[57] ABSTRACT

A scroll type compressor comprises an immovable scroll defining a spiral space, and a refrigerant is introduced into an outermost zone of the spiral space. The compressor further comprises a movable scroll engaged with the immovable scroll such that the outermost zone of the spiral space is divided into an inner section and an outer section by an outermost portion of the movable scroll. The movable scroll is revolved around a center axis of the immovable scroll such that the inner and outer sections are alternatively displaced as a compression chamber toward a center of the immovable scroll, and a refrigerant inlet port of the inner section is defined by a termination of the outermost portion of the movable scroll. The termination is disengaged from and engaged with the immovable scroll during the revolution of the movable scroll to close and open the inlet port of the inner section. The immovable scroll has a communication passage formed in a base portion thereof, and the inner and outer section is in communication with each other through the communication passage only when the termination is disengaged from the immovable scroll so that the inlet port of the inner section is opened, whereby the refrigerant can be fed to the inner section not only through the inlet port thereof, but also through the communication passage until the termination is engaged with the immovable scroll so that the inlet port of the inner section is closed.

1 Claim, 3 Drawing Sheets

SCROLL TYPE COMPRESSOR HAVING COMMUNICATION PASSAGE MEANS WITH LUBRICATING ARRANGEMENT ASSOCIATED THEREWITH

BACKGROUND OF THE INVENTION

1. Field of the Invention

The present invention relates to an improvement of a scroll type compressor which can be used, for example, in an air-conditioning system of a vehicle such as an automobile.

2. Description of the Related Art

For example, Japanese Unexamined Utility Model Publication No. 60-125382 discloses a scroll type compressor for an air-conditioning system of an automobile, which comprises immovable and movable scroll members housed in a housing and having spiral guide walls engaged with each other in such a manner that spaces are formed as a compression chamber therebetween. The movable scroll member is revolved around a central axis of the immovable scroll member in such a manner that an engagement is maintained between the spiral guide walls of the immovable and movable scroll members, and that the spaces or compression chambers therebetween are displaced toward the central axis of the immovable scroll member.

During the revolution of the movable scroll member around the central axis of the immovable scroll member, a compression chamber appears successively at the outermost portions of the spiral guide walls thereof, and opens to take in a refrigerant fed from an evaporator of the air-conditioning system, and then the compression chamber concerned is fully closed by the spiral guide walls, due to the revolution of the movable scroll member. Thereafter, as the compression chamber concerned is displaced toward the central axis of the immovable scroll member, a volume thereof becomes gradually smaller, whereby the refrigerant confined therein is compressed, and when the compression chamber concerned reaches the central axis of the immovable scroll member, the compressed refrigerant is discharged through a reed valve into a discharge chamber formed in the housing of the compressor. After the discharge of the compressed refrigerant into the discharge chamber is completed, the compression chamber concerned disappears at the central axis of the immovable scroll member, and thus a compression of the refrigerant is successively carried out.

A spiral space defined by the spiral guide wall of the immovable scroll member is in communication with the suction chamber through an inlet passage provided at the outermost zone of the spiral space at which a compression chamber successively appears during the revolution of the movable scroll member, whereby the refrigerant can be effectively introduced from the suction chamber into the compression chamber while the latter opens. Nevertheless, conventionally, the effective introduction of the refrigerant into the compression chamber cannot be completely carried out.

In particular, the immovable and movable spiral guide walls are engaged with each other in such a manner that the outermost zone of the spiral space defined by the immovable spiral guide wall is divided into an inner section and an outer section by the outermost portion of the movable spiral guide wall, and the inner and outer sections are alternatively displaced as a compression chamber toward the central axis of the immovable scroll member during the revolution of the movable scroll member around the central axis of the immovable scroll member. An inlet port of the inner section for feeding the refrigerant thereto is defined by a termination of the outermost portion of the movable spiral guide wall, and said termination is disengaged from and engaged with the immovable spiral guide wall during the revolution of the movable scroll member around the central axis of the immovable scroll member to close and open the inlet port of the inner section. In this case, the inner section cannot be fed with a sufficient amount of refrigerant, because the inlet port of the inner section is restricted and closed by the termination of the outermost portion of the movable spiral guide wall, and because a part of the refrigerant introduced from the suction chamber into the outermost zone of the spiral space through the inlet passage is directed to the outer section.

SUMMARY OF THE INVENTION

Therefore, an object of the present invention is to provide an improved scroll type compressor constituted such that all of the compression chambers can be sufficiently fed with a refrigerant, whereby the compressor can be operated at a high efficiency.

According to the present invention, there is provided a scroll type compressor comprising: an immovable scroll means having an spiral guide wall to define a spiral space; a refrigerant introduction means for introducing a refrigerant into an outermost zone of the spiral space defined by the spiral guide wall of the immovable scroll means; a movable scroll means having a spiral guide wall engaged with the spiral guide wall of the immovable scroll means in such a manner that the outermost zone of the spiral space is divided into an inner section and an outer section by an outermost portion of the spiral guide wall of the movable scroll means, the movable scroll means being revolved around a center axis of the immovable scroll means in such a manner that the inner and outer sections are alternatively displaced as a compression chamber toward a center of the immovable scroll means, an inlet port of the inner section for feeding the refrigerant thereto being defined by a termination of the outermost portion of the spiral guide wall of the movable scroll means, the termination being disengaged from and engaged with the spiral guide wall of the immovable scroll means during the revolution of the movable scroll means around the center axis of the immovable scroll means to close and open the inlet port of the inner section; and a communication passage means provided in the immovable scroll means so that the inner section is in communication with the outer section only when the termination is disengaged from the spiral guide wall of the immovable scroll means so that the inlet port of the inner section is opened, whereby the refrigerant can be fed to the inner section not only through the inlet port thereof, but also through the communication passage means until the termination is engaged with the spiral guide wall of the immovable scroll means so that the inlet port of the inner section is closed.

Preferably, the communication passage means comprises an arcuate communication passage formed in a base portion of the immovable scroll means and extended along an outer peripheral side edge defining the outermost zone of the spiral space.

BRIEF DESCRIPTION OF THE DRAWINGS

The above-mentioned object and other objects of the present invention will be better understood from the following description, with reference to the accompanying drawings, in which.

DESCRIPTION OF THE PREFERRED EMBODIMENTS

Figure 1:
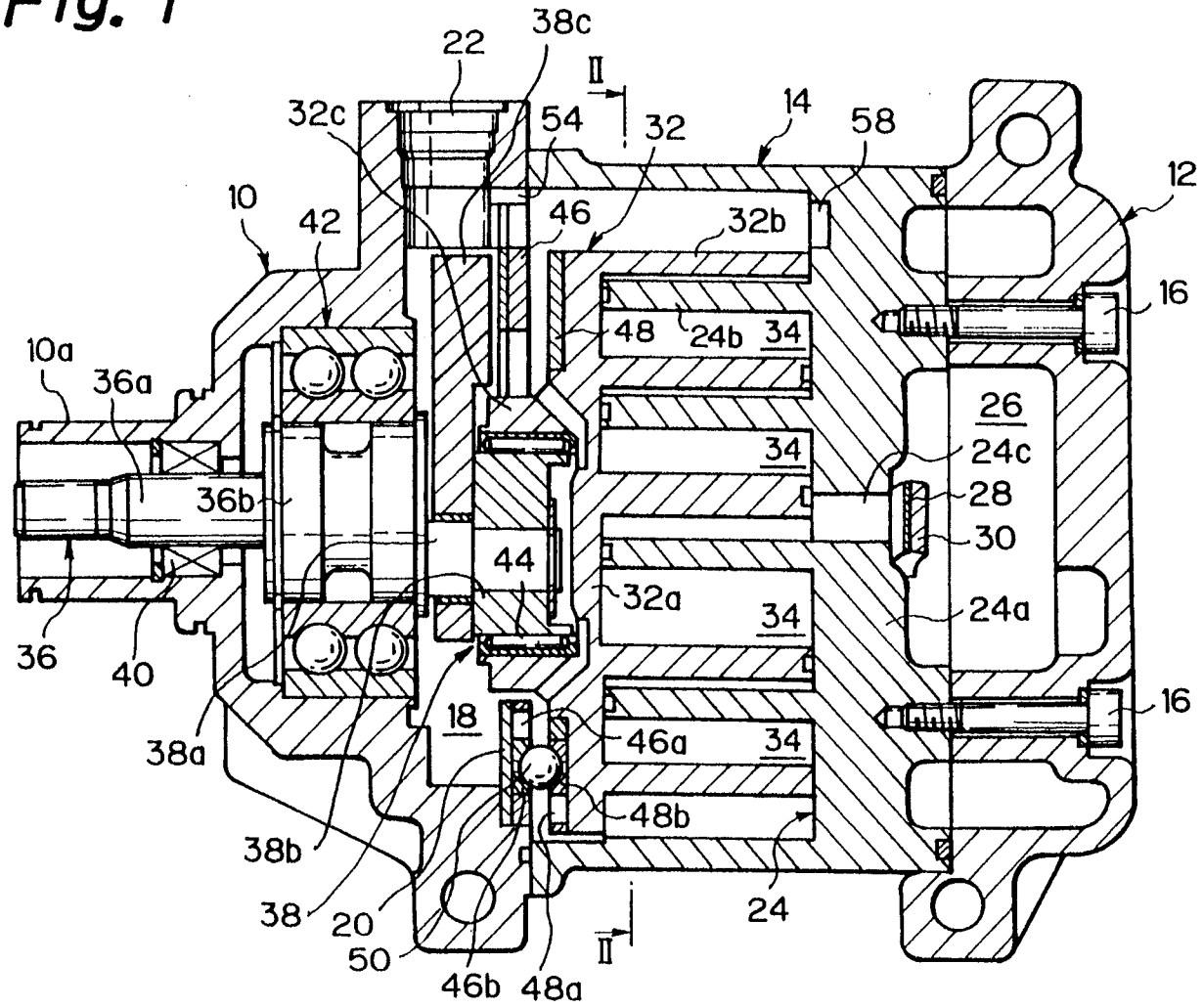
FIG. 1 is a longitudinal sectional view of a scroll type compressor constructed according to the present invention.

FIGS. 1 through 4 show an embodiment of a scroll type compressor according to the present invention. This compressor comprises front and rear housings 10 and 12, and an intermediate housing 14 disposed therebetween, and the front and rear housings 10 and 12 are joined to the front and rear ends of the intermediate housing 14 by suitable screws, respectively. Note, in FIG. 1, only two screws for joining the rear housing 12 to the rear end of the intermediate housing 14 are indicated by reference numerals 16. The front housing 10 defines a suction chamber 18 together with an annular disk plate 20 fixedly disposed at a boundary between the front and intermediate housings 10 and 14, and the suction chamber 18 is in communication with, for example, an evaporator of an air-conditioning system (not shown), through an inlet port 22 formed in a side wall of the front housing 10, whereby a refrigerant including a lubricating oil mist is fed to the suction chamber 18 from the evaporator. Note, the various movable parts of the compressor that are located in the chamber 18 are lubricated by the oil mist included in the refrigerant.

The compressor also comprises an immovable scroll member 24 housed in the intermediate housing 14 and including a base portion 24*a* integrally formed therewith, and a spiral guide wall 24*b* integrally projected from a front wall surface of the base portion 24*a*. As apparent from FIG. 1, the base portion 24*a* of the scroll member 24 defines a discharge chamber 26 together with the rear housing 12, and the discharge chamber 26 is communicated with a condenser of the air-conditioning system through an outlet port (not visible in FIG. 1) formed in the rear housing 12. The base portion 24*a* of the immovable scroll member 24 has a central through passage 24*c* formed therein, and thus an interior defined by the intermediate housing 14 is in communication with the discharge chamber 26. The through passage 24*c* is usually closed by a reed valve 28 attached to the rear side wall surface of the base portion 24*a*, and when the reed valve 28 is open as shown in FIG. 1, it is held open by a retainer 30.

The compressor further comprises a movable scroll member 32 movably disposed in the intermediate housing 14 and including a base portion 32*a* opposed to and spaced apart from the base portion 24*a* of the immovable scroll member 24, and a spiral guide wall 32*b* integrally projected from a rear wall surface of the base portion 32*a*. The spiral guide wall 32*b* of the movable scroll member 32 is engaged with the spiral guide wall 24*b* of the immovable scroll member 24 so that spaces or compression chambers 34 are formed therebetween. Each of the spiral guide walls 24*b* and 32*b* may have a profile defined by an involute line, and as clearly shown in FIGS. 2 and 3 the radially outermost portion of the movable spiral guide wall 32*b* is gradually thinned towards the radially outer termination thereof.

The movable scroll 32 is revolved around a central axis "O" of the immovable scroll member 24 (FIGS. 2 and 3) in such a manner that an engagement is maintained between the spiral guide walls 24*a* and 32*a*, whereby the compression chambers 34 are successively displaced toward the center of the immovable scroll member 24. Note, in FIGS. 2 and 3, reference "Q" indicates a central axis of the movable scroll member 32. To revolve the movable scroll member 32 around the central axis "O " of the immovable scroll member 24, the compressor comprises a drive shaft 36 operatively connected to and rotated by, for example, a prime mover of the vehicle, through a suitable clutch such as an electromagnetic clutch, and an eccentric mechanism 38 provided between the drive shaft 36 and the movable scroll member 32 for converting the rotation of the drive shaft 36 into the revolution of the movable scroll member 32.

In particular, the drive shaft 36 includes a shaft portion 36*a* and an enlarged portion 36*b* integrated with an inner end thereof, and is disposed within the front housing 10 so that a longitudinal axis thereof is aligned with the central axis "O" of the immovable scroll member 24. The shaft portion 36*a* of the drive shaft 36 is received in an outer sleeve portion 10*a* projected from the front housing 10 and is rotatably supported by a seal-assembly 40 disposed in the outer sleeve portion 10*a*, and the enlarged portion 36*b* thereof is received in the front housing 10 rotatably supported by a radial bearing 42 fixedly housed therein. The eccentric mechanism 38 includes an eccentric pin element 38*a* integrally projected from an inner end face of the enlarged portion 36*b* of the drive shaft 36, and a bush element 38*b* rotatably engaged with the eccentric pin element 38*a*. The bush element 38*b* is rotatably received in a sleeve portion 32*c* projected from the movable scroll member 32 into a central opening of the annular disk plate 20 and provided with a radial bearing 44 for rotatably receiving the bush element 38*b*. With this arrangement, the movable scroll member 32 can be revolved around the central axis of the immovable scroll member 24 by the rotation of the drive shaft 36. Note, the eccentric pin element 38*a* is provided with a counterweight 38*c*, to ensure that the eccentric mechanism 38 is stably driven.

To constrain the movement of the movable scroll member 32 so as to ensure the revolution thereof around the central axis "O" of the immovable scroll member 24, the compressor comprises a first annular plate 46 securely attached to the annular disk plate 20 at a rear side thereof and having a plurality of circular recesses 46*a* formed therein, and a second annular plate 48 securely attached to the base portion 32*a* of the movable scroll member 32 so as to face the first annular plate 46 and having the same number of circular recesses 48*a* formed therein. The circular recesses 46*a* and 48*a* of the first and second annular plates 46 and 48 are radially disposed at regular intervals so that each of the circular recesses 46*a* of the first annular plate 46 partially overlaps the corresponding circular recess 48*a* of the second annular plate 48. Two shoe elements 46*b* and 48*b* are slidably received in each set of the partially overlapped circular recesses 46*a* and 48*a* of the first and second annular plates 46 and 48, respectively, and a ball element 50 is slidably disposed between and held by the two shoe elements 46*b* and 48*b*. With this arrangement, the movement of the movable scroll member 32 is constrained so that the revolution thereof around the central axis of the immovable scroll member can be ensured. Namely, a rotation of the movable scroll member 32 around its own central axis "Q" is prevented during the revolution thereof around the central axis "O" of the immovable scroll member 24.

Figure 2:
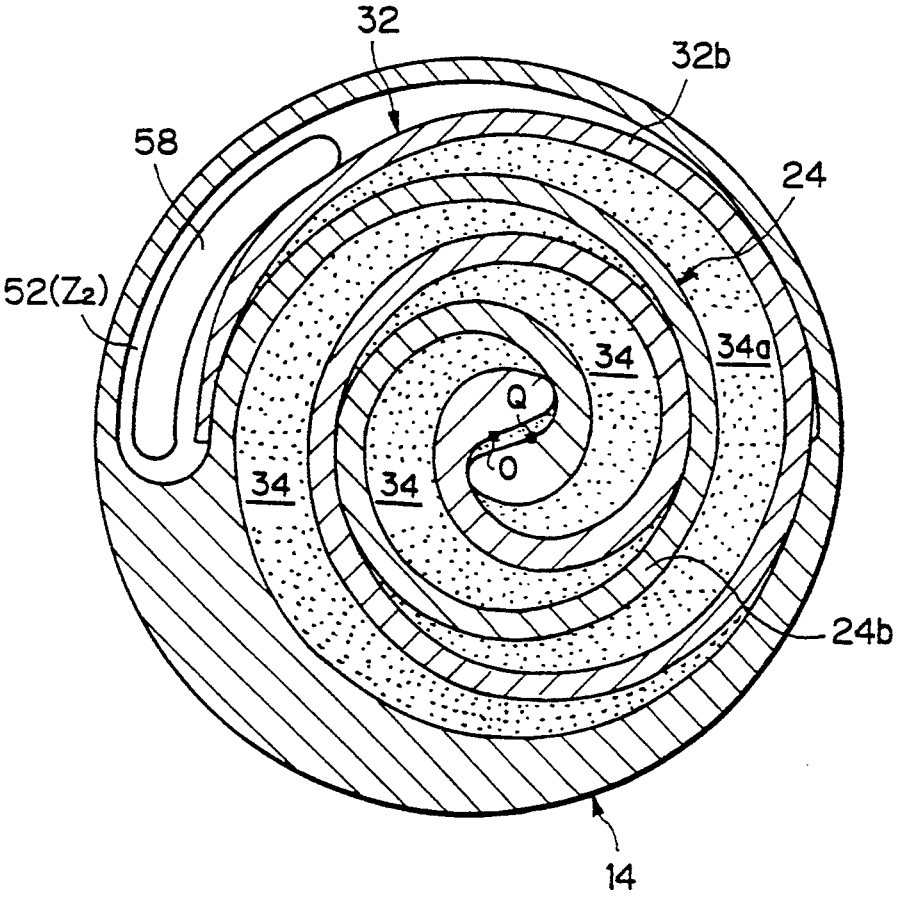
FIG. 2 is a cross-sectional view taken along the line II—II of FIG. 1.
Figure 3:
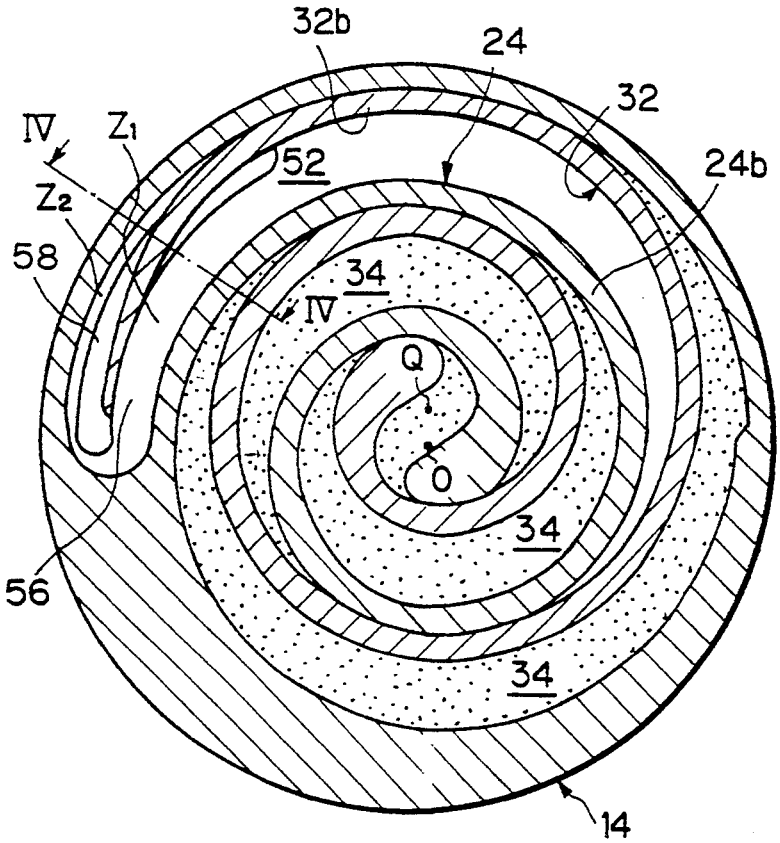
FIG. 3 is a cross-sectional view similar to FIG. 2, but a movable scroll member of the compressor is shown at a different phase.
Figure 4:
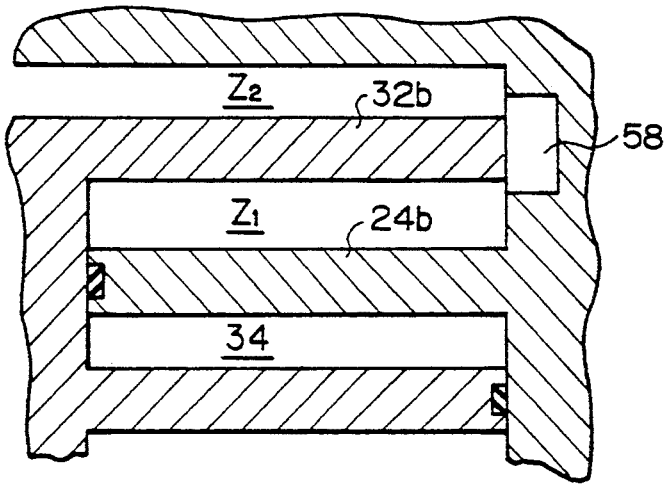
FIG. 4 is a sectional view taken along the line IV—IV of FIG. 3.

As shown in FIG. 3, the spiral guide wall 24*b* of the immovable scroll member 24 defines a spiral space 52 in the interior of the intermediate housing 14, and the immovable and movable spiral guide walls 24*b* and 32*b* are engaged with each other in such a manner that the outermost zone of the spiral space 52 is divided into an inner section $Z_1$ and an outer section $Z_2$ by the outermost portion of the movable spiral guide wall 32*b*, and the inner and outer sections $Z_1$ and $Z_2$ are alternately displaced as a compression chamber (34) toward the central axis of the immovable scroll member 24 during the revolution of the movable scroll member 32 around the central axis of the immovable scroll member 24, as apparent from FIGS. 2 and 3. Namely, the compression chamber is successively created at the 30 outermost zone of the spiral space 52. As shown in FIG. 1, the refrigerant is introduced from the suction chamber 18 into the outermost zone of the spiral space 52 through an inlet passage 54 formed and disposed at a location beside a rotational zone of the counterweight 38*c*, and thus the refrigerant is fed to the inner and outer sections $Z_1$ and $Z_2$.

As apparent from FIG. 3, an inlet port 56 of the inner section $Z_1$ for feeding the refrigerant thereto is defined by a termination of the outermost portion of the movable spiral guide wall 32*b*, and the termination is disengaged from and engaged with the immovable spiral guide wall 24*b* during the revolution of the movable scroll member 32 around the central axis of the immovable scroll member 24 to close and open the inlet port 56 of the inner section $Z_1$, as shown in FIGS. 2 and 3. Although the inlet port 56 of the inner section $Z_1$ is opened, it is restricted by the termination of the outermost portion of the movable spiral guide wall 32*b*, and a part of the refrigerant introduced from the suction chamber 18 into the outermost zone of the spiral space 52 through the inlet passage 54 is directed to the outer section $Z_2$. Accordingly, a sufficient amount of the refrigerant cannot be fed to the inner section $Z_1$ only through the inlet port 54 thereof.

Nevertheless, according to the present invention, the refrigerant can be sufficiently fed to the inner section $Z_1$ due to an arcuate communication passage 58 formed in the front wall surface of the base portion 24*a* of the immovable scroll member 24 and extended along an outer peripheral side edge defining the outermost zone of the spiral space 52, as best shown in FIG. 3. When the inlet port 56 of the inner section $Z_1$ is opened, as shown in FIG. 3, the outermost portion of the movable spiral guide wall 32*b* crosses over the arcuate communication passage 58, so that the inner section $Z_1$ is in communication with the outer section $Z_2$, whereby the refrigerant can be further fed from the outer section $Z_2$ to the inner section $Z_1$ through the communication passage 58, the feeding of the inner section $Z_1$ being facilitated by the thinned portion of the guide wall 32*b*. Namely, the feeding of the refrigerant to the inner section $Z_1$ can be carried out not only through the inlet port 56, but also through the communication passage 58, and thus a sufficient amount of the refrigerant can be fed to the inner section $Z_1$.

As shown in FIG. 2, the arcuate communication passage 58 is disposed such that the inner section $Z_1$ is isolated therefrom when the termination of the outermost portion of the movable spiral guide wall 32*b* is engaged with the immovable spiral guide wall, i.e., when the inlet port 56 of the section $Z_1$ is closed. Thus, the refrigerant constrained in the inner section $Z_1$, namely, a compression chamber indicated by reference 34*a* in FIG. 2, cannot escape therefrom into the outer section $Z_2$ through the communication passage 58. Note, when the termination of the outermost portion of the movable spiral guide wall 32*b* is engaged with the immovable spiral guide wall (FIG. 2), all of the refrigerant is discharged from the suction chamber 18 into the outermost zone of the spiral space 52, and therefore, the outer section $Z_2$, through the inlet passage 54, and thus a sufficient amount of the refrigerant can be always fed to the outer section $Z_2$.

Although not illustrated, in place of the arcuate communication passage 58, a plurality of radial communication passages may be formed in the front wall surface of the base portion 24*a* of the immovable scroll member 24, if necessary.

As apparent from the foregoing, according to the invention, since all of the compression chambers can be sufficiently fed with the refrigerant, the compressor can be operated at a high efficiency.

Finally, it will be understood by those skilled in the art that the foregoing description is of a preferred embodiment of the present invention, and that various changes and modifications thereof can be made without departing from the spirit and scope thereof.

We claim:

1. A scroll type compressor comprising:

an immovable scroll means having a base portion with a front facing wall surface and a spiral guide wall extending integrally from said front facing wall surface to define a spiral space;

housing means provided in front of said immovable scroll means defining a suction chamber and including means for feeding said suction chamber with a refrigerant including a lubricating oil mist;

a refrigerant introduction means provided between said housing means and said immovable scroll means for introducing said refrigerant into the radially outermost zone of the spiral space defined by the spiral guide wall of said immovable scroll means;

a movable scroll means having a spiral guide wall engaged with the spiral guide wall of said immovable scroll means in such a manner that said outermost zone of said spiral space is divided into a radially inner section and a radially outer section by the radially outermost portion of the spiral guide wall of said movable scroll means which radially outermost portion is gradually thinned toward the radially outer termination thereof, said movable scroll means being revolvable around a center axis of said immovable scroll means in such a manner that said inner and outer sections of said outermost zone of said spiral space are alternately displaced as a compression chamber toward the center of the immovable scroll means, an inlet port for said inner section for feeding the refrigerant to the latter being defined by the termination of the radially outermost portion of the spiral guide wall of said movable scroll means, said spiral wall termination being brought into disengagement from and engagement with the spiral guide wall of said immovable scroll means during the revolving of said movable scroll means around the center axis of said immovable scroll means to close and open said inlet port of said inner section;

mechanical means provided within said housing means in said suction chamber for revolving said movable scroll means around the central axis of said immovable scroll means, the movable parts of said mechanical means being lubricated with the oil mist included in the refrigerant fed to said suction chamber; and an arcuate communication passage [means provided]-formed in said front facing wall surface of the base portion of said immovable scroll means and extending along the side edge of the radially outer portion of said movable spiral wall within said radially outermost zone of said spiral space so that said inner section is in communication with said outer section only when said termination of the movable spiral wall is disengaged from the spiral guide wall of said immovable scroll means so that the inlet port of said inner section is opened, whereby the refrigerant is fed to said inner section not only through the inlet port thereof, but also through said communication passage means until said termination of the movable spiral wall is brought into engagement with the spiral guide wall of said immovable scroll means so that the inlet port of said inner section is closed.

* * * * *